US007249398B2

(12) United States Patent
Roy

(10) Patent No.: US 7,249,398 B2
(45) Date of Patent: Jul. 31, 2007

(54) DEVICE FOR FIXING A WATCHBAND TO A WATCH CONTAINER

(75) Inventor: Francis Roy, Cran Gevrier (FR)

(73) Assignee: Richemont International S.A., Villars-Sur-Glane (CH)

( * ) Notice: Subject to any disclaimer, the term of this patent is extended or adjusted under 35 U.S.C. 154(b) by 84 days.

(21) Appl. No.: 10/528,138

(22) PCT Filed: Sep. 16, 2003

(86) PCT No.: PCT/IB03/03958

§ 371 (c)(1),
(2), (4) Date: Mar. 17, 2005

(87) PCT Pub. No.: WO2004/027523

PCT Pub. Date: Apr. 1, 2004

(65) Prior Publication Data

US 2006/0162132 A1 Jul. 27, 2006

(30) Foreign Application Priority Data

Sep. 17, 2002 (EP) ..... 02020804

(51) Int. Cl.
*A44C 5/14* (2006.01)
*G04B 37/00* (2006.01)

(52) U.S. Cl. ..... 24/265 B; 24/365 WS

(58) Field of Classification Search ..... 24/70 J, 24/265 R, 69 J, 265 B, 68 J, 71 J, 265 WS; 63/3, 3.1, 7, 9, 10, 21–25; 368/282
See application file for complete search history.

(56) References Cited

U.S. PATENT DOCUMENTS 2,870,509 A * 1/1959 Gaylord ..... 24/654
2,992,467 A * 7/1961 Gaylord ..... 24/606
4,716,631 A * 1/1988 Gay ..... 24/265 B
6,014,793 A * 1/2000 Howald ..... 24/265 B
6,401,307 B1 * 6/2002 Wild ..... 24/71 J
6,408,490 B1 6/2002 Pequignet ..... 24/265 WS
6,923,593 B2 * 8/2005 Nussbaum ..... 403/328

FOREIGN PATENT DOCUMENTS

| | | | |
|---|---|---|---|
| CH | 664 663 G A3 | * | 3/1988 |
| EP | 0 133 068 A1 | * | 2/1985 |
| FR | 2 743 641 A1 | * | 1/1996 |
| GB | 2 264 628 A | * | 9/1993 |
| GB | 2 297 236 A | * | 7/1996 |
| WO | WO 93/10486 | * | 5/1993 |

* cited by examiner

*Primary Examiner*—J. J. Swann
*Assistant Examiner*—Ruth C Rodriguez
(74) *Attorney, Agent, or Firm*—Young & Thompson

(57) ABSTRACT

Device for fixing a watchband to a watch container includes a hinge connected to the watch container with two pivots sliding therein and a fixing element fixed to or integrated into the end of the watchband provided with two brackets defining a space therebetween for arranging the hinge. Each bracket has an axial recess protruding in the space between the brackets. The axial recess is extended in a direction of the external side faces of the brackets through an orifice containing an end stone mounted such that it is slidable in the recess and exposed to the action of a second return spring which pushes a press button fixed to the external ends of the end stone towards outside. The hinge is provided on the side faces thereof with an annular chamber having a slot which defines a privileged direction.

4 Claims, 3 Drawing Sheets

DEVICE FOR FIXING A WATCHBAND TO A WATCH CONTAINER

The present invention concerns a device for fastening of a watch strap to a watch case comprising a hinge pin integral with the watch case in which two pivots slide, subject to the action of a first return spring tending to separate them so that the external ends of the pivots emerge from the lateral faces of said hinge pin, and comprising a fastening element attached to or integrated to the end of a strap that provides two lugs defining between one another a space intended to receive the hinge pin, each of these lugs comprising an axial recess leading to the space comprised between these two lugs.

This invention needs to be considered within the context of interchangeable straps allowing changing the strap of a watch on some occasions or depending on the wish of the watch owner. Such interchangeable straps exist, nevertheless comprising a number of disadvantages. Either this kind of straps are easily removed and fitted by the user, and without any tool, but the disadvantage in this case is that they risk undoing themselves and thus the watch can be dropped or even lost. Or this risk is reduced or cancelled, the straps often having in this case the disadvantage of requiring a tool in order to be changed, this being opposite to the aim of the invention.

The aim of the present invention is to provide a simple solution to this contradictory problem by embodying a device for fastening a watch strap to a watch case, which allows an interchangeability of the strap being easily and quickly carried out by the user. In particular, this operation does not require a tool. Simultaneously, this solution guarantees an improvement in the safety of this operation because the risk is greatly reduced that the connection between the interchangeable strap and the watch comes apart. Thus, this invention enables the users themselves to attach the straps on a watch to their liking, for instance in different colours or different materials such as metal, leather, etc.

The present invention deals with a device for fastening a watch strap to a watch case which is distinguishable by the fact that the axial recess is extended towards the outer lateral faces of the lugs by an hole housing a endstone mounted in a sliding manner in this recess and bearing a push button attached to the outer ends of the endstones, and by the fact that the hinge pin comprises on its lateral faces an annular housing having a groove defining an advantageous orientation, this annular housing being intended to cooperate with a protrusion located on the internal faces of the lugs.

The appended drawings illustrate schematically and by way of an example a kind of implementation of the device for fastening a strap to a watch case according to the invention.

Figure 1:
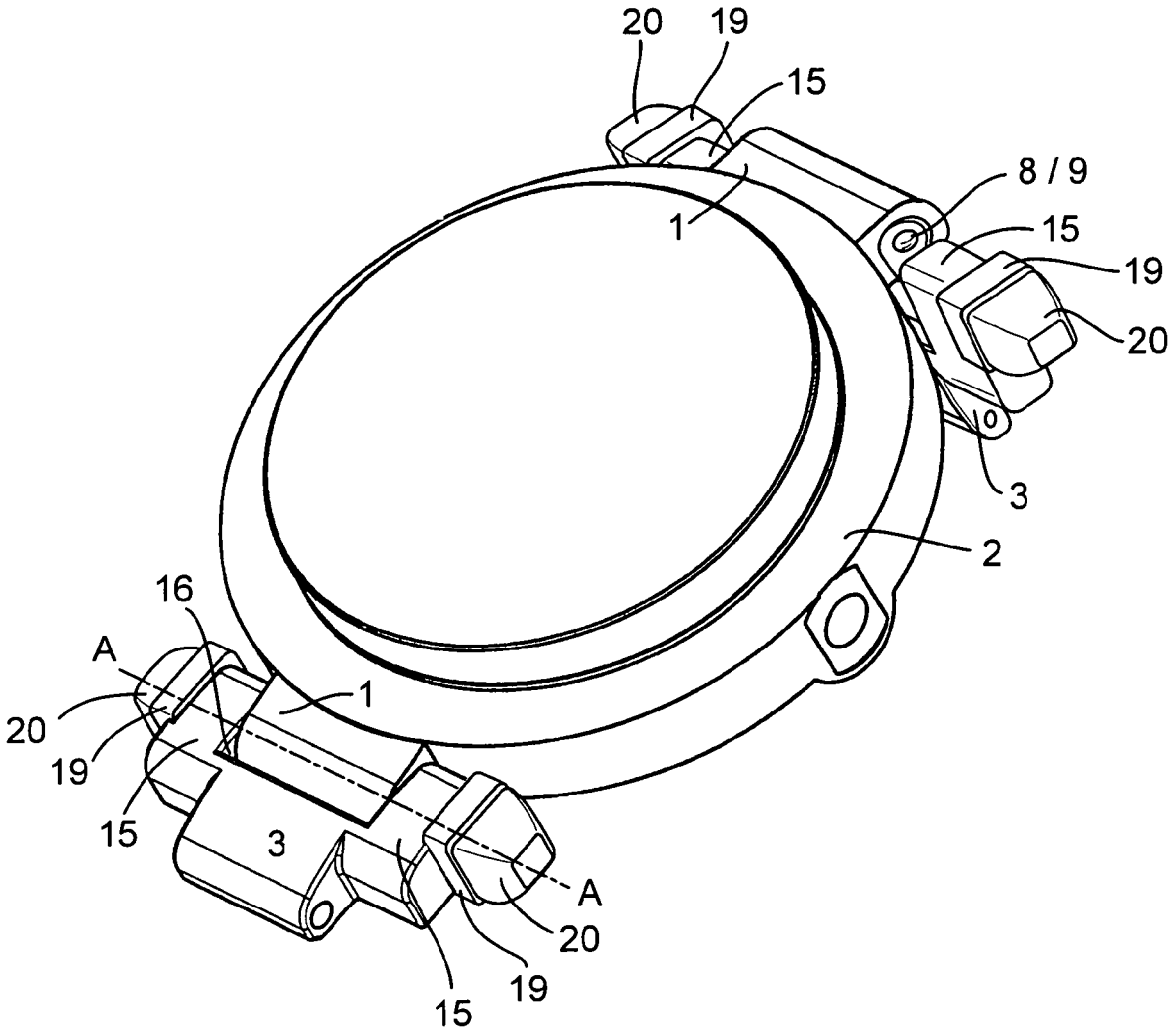
FIG. 1 illustrates a watch case fitted with the fastening device according to the invention, coupled to connecting pieces of the ends of the strap.
Figure 3:
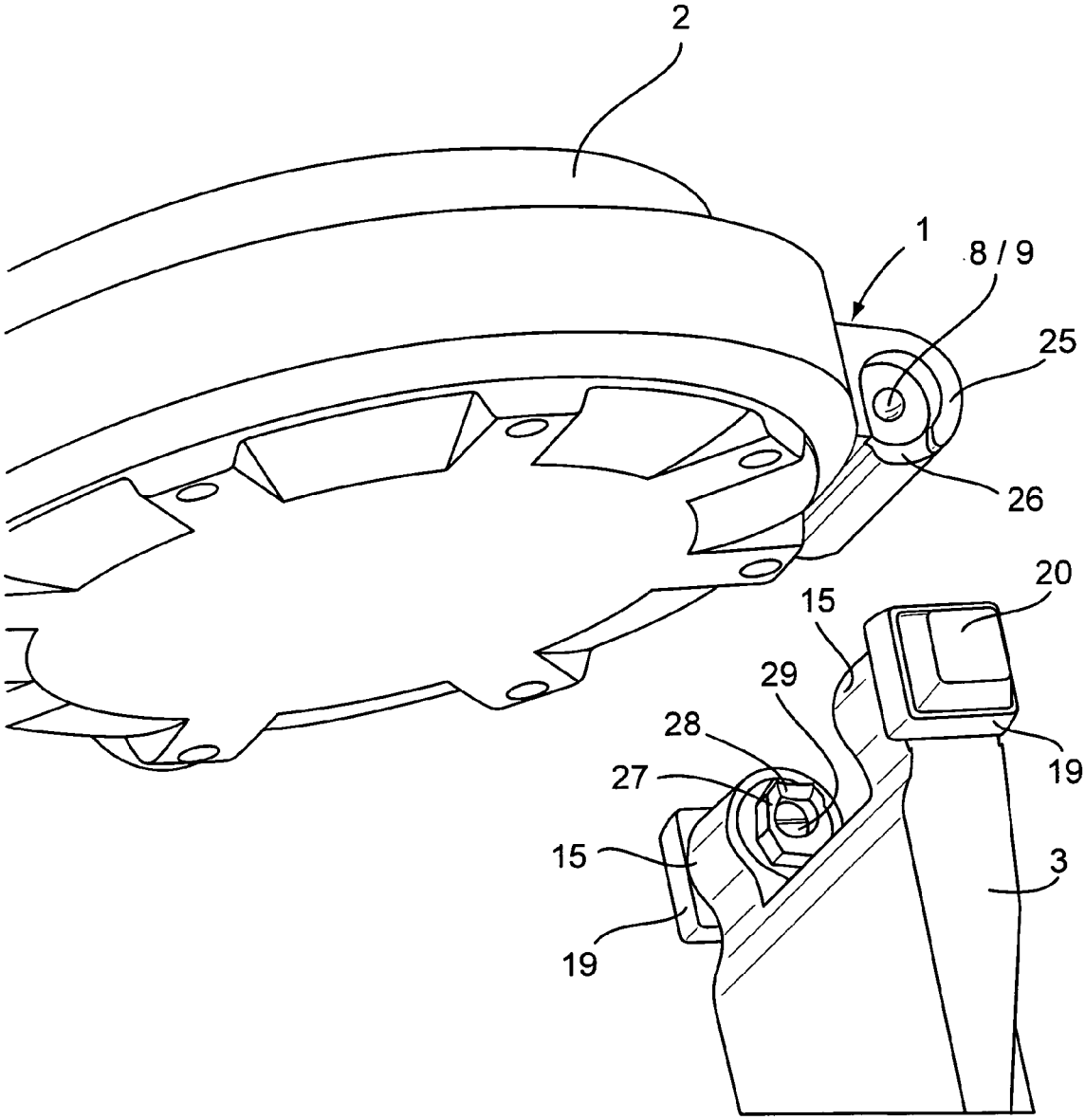
FIG. 3 is an illustration of the operation for setting the strap to the watch case.

The device for fastening a strap to a watch case illustrated on FIG. 1 comprises a hinge pin 1 integral with the watch case 2, somewhat replacing the usual horns, and a fastening element 3 intended to be attached to the end of a strap needing to be coupled to the watch case 2. This element 3 can also be integrated during manufacturing to the end of the strap, as shown on FIG. 3.

Each hinge pin 1 comprises a transversal through-passage presenting three parts, a small diameter part 4 leading to one of its lateral edges, a middle part 5 of bigger diameter and a large diameter part 6, provided with a thread 7, leading to the other lateral edge of the hinge pin 1.

In this transversal passage 4, 5, 6, two pivots 8, 9 are housed, comprising a central part with a diameter corresponding to the diameter of the middle part 5 of the through-passage of the hinge pin 1. Each pivot comprises an inner end of smaller diameter introduced in a first helical spring 10 also housed in the transversal passage 4, 5, 6 and tending to separate the pivots 8, 9 from one another.

A threaded socket 11 is screwed in the thread 7 and comprises a final piercing 12 of same diameter than part 4 of small diameter of the transversal passage 4, 5, 6 of the hinge pin 1 leading to a housing 13 presenting a diameter corresponding to the one of the middle part of the transversal passage 4, 5, 6. In this housing 13, the middle part of the pivot 9 slides.

Figure 2:
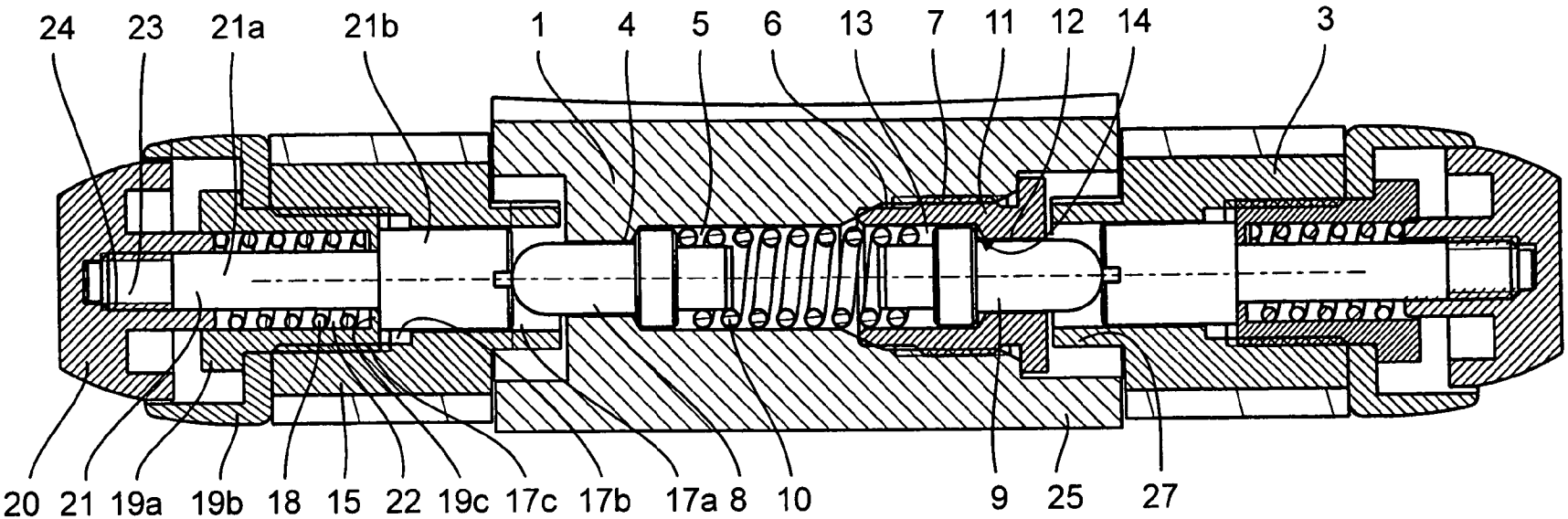
FIG. 2 is a partial section view along the A-A line of FIG. 1, following a plane perpendicular to the bottom of the watch case.

Thus, in use, the pivots 8, 9 slide transversely in the hinge pin 1 and are subject to the action of the spring 10 which tends to separate them from one another. The outer terminal ends of the pivot 8, 9 emerge from the lateral faces of the hinge pin 1, and the pivots 8, 9 are held in position by their shoulder 14 coming in abutment respectively against the hinge pin 1 and the sleeve 11 screwed in the hinge pin 1, as illustrated in FIG. 2.

The hinge pin 1 further comprises, on its lateral faces, an annular housing 25 surrounding, by leaving empty an annular space, the outer terminal parts of the pivot 8, 9 emerging in these lateral faces. Moreover, this annular housing 25 comprises a groove 26, as illustrated on FIG. 3, which defines an advantageous orientation of the interchangeable strap intended to be set on the hinge pin 1. This groove 26 is preferably perpendicularly oriented downwards relative to the watch case. The angle between a line skirting a face of this groove 26 and the bottom plane of the watch case is thus comprised preferably between 80° and 100°, and is a right angle in the illustrated example. The annular housing 25 is deeper at the face of the hinge pin 1 intended to receive the sleeve 11, so that the actual depth of the annular housings 25 is identical at each lateral face of the hinge pin 1 once this sleeve 11 is screwed in the hinge pin 1.

The fastening element 3 can be comprised of the last link of a metallic strap or a piece integrated to the end of a leather strap. In the illustrated example on FIG. 3, the element 3 is a part of the end of the strap. In the illustrated example on FIG. 1, this element 3 comprises a post fitted with a piercing. This post is intended to be attached to the end of a metallic strap with a pin passing through this piercing. This element 3 further comprises two lugs 15 separated by a recess 16 intended to receive the hinge pin 1 of the watch case. These lugs 15 comprise a recess 17 each with a part 17*b* of bigger diameter comprising a thread 17*c* on their outer lateral faces. A part 17*a* of smaller diameter of this recess 17 leads to the inner edge of these lugs 15.

End tips 19 are screwed in the parts 17*b* of the recesses 17 of the lugs 15 using the thread 17*c*. These end tips 19 comprise a through-hole 22 extending the recesses 17 outwards, and in which an endstone 21 slides.

These end tips 19 can be comprised of an internal part 19*a* of substantially cylindrical shape and of an external part 19*b* which, in this case, can be applied against the outer face of the lugs 15 by an external shoulder of the outer faces of the internal parts 19*a*, as represented on FIG. 2. The end tips 19 could still be made in one piece.

The internal part 19*a* of the end tips 19 also comprises, towards its internal face, a shoulder 19*c* separating the housing formed by the recess 17 of the lugs 15 and the through-hole 22 in two parts, and defining simultaneously a smaller diameter than the one of the through-hole 22, which is preferably identical to the one of the recess 17.

Thus, the endstones 21 comprise two parts of different diameter. An internal part of the endstone 21*b* presents a bigger diameter corresponding to the one of the recess 17, in which this part 21*b* slides so as to be retained by the shoulder 19*c*, against which it comes in abutment. An external part of the endstone 21*a* presents a smaller diameter corresponding to the one defined by the shoulder 19*c* of the end tips 19. A second return spring 18 can therefore be housed between the external part of the endstone 21*a* and the internal wall of the through-hole 22 of the end tips 19. Thus, the second return spring 18 being applied from its internal face against the external face of the shoulder 19*c*, which it tends to outwardly push a push button 20 attached to the outer end of the external part of the endstone 21*a* and housed in the external part 19*a* of the end tips 19. This push button 20 can for instance be screwed to the thread 24 of the outer end 23 of the endstone 21.

The normal position of the push buttons 20, maintained by the second springs 18, is therefore the one in which the internal part 21*b* of the endstones 21 is in abutment against the shoulder 19*c* of the end tips 19, the push buttons being pushed outwardly by these springs 18.

In the internal face of each lug 15, an annularly shaped protrusion 27 is fitted, which the depth corresponds to the diameter of the end of the pivots 8, 9 laterally emerging from the hinge pin 1, as well as to the aforementioned actual depth of the annular housings 25.

The width of this protrusion 27 corresponds to the width of the groove 26 fitted in the annular housing 25 so that the strap can be inserted, respecting the aforementioned advantageous orientation, in its position in which the connection with the watch case is set up. In this position, in order to stabilize this connection, the ends of the pivots 8, 9 laterally emerging from the hinge pin 1 are housed in a central recess 29 of the protrusions 27 representing a coaxial extension of same diameter of the recess 17 of the lugs 15. To facilitate the operation for setting the strap and specifically the outer ends of the pivots 8, 9 in these central recesses 29, the protrusions 27 further comprise a guiding cut 28 provided on the protrusions so that, by bringing the strap in the advantageous orientation closer to the hinge pin 1, the outer ends between the pivots 8, 9 latch in the recesses 29 of the protrusions 27 of the hinge pin 1. These guiding cuts 28 are in particular preferably formed in the protrusions 27, on their outer face seen on the axis of the strap, as indicated on FIG. 3. As it is also indicated on this FIG., the external walls of the protrusions 27 can comprise an aligned straight part, the strap being oriented in the advantageous direction at the bottom of the watch case, with the walls of the groove 26 in order to reinforce the need for correctly orienting the pieces to be able to fit or remove the strap.

To remove a strap from the watch case 2, the user has to simultaneously push both push buttons 20 and orientate the strap downwards perpendicularly relative to the watch case. When pressing the push button, he pushes in the endstones 21 which withdraws the pivots 8, 9 in the hinge pin 1 (see FIG. 2). When pulling on the strap in the axis of the latter which is located in the advantageous orientation for this operation, the connecting element 3 is then separated from the hinge pin 1 because the protrusion 27 can leave the annular housing 25, and the strap is disconnected from the watch case 2. Because we have to simultaneously press both push buttons 20 and orientate the strap downwards perpendicularly, which is only possible if the watch is not on the wrist, that way a double safety is achieved. At the same time, this operation does not require a tool and thus allows the watch owner to change the strap at any time.

In order to assemble a strap to the watch case, the user presents the connecting element 3 underneath the hinge pin 1. If the strap is oriented in the manner aforementioned and represented on the FIG. 3, the protrusions 27 can be inserted in the annular housings 25, the guiding cuts 28 being engaged with the pivots 8, 9 coming out of the hinge pin 1. The user then forces the fastening element 3 on the hinge pin, the inclined planes of the guiding cuts 28 withdraw the pivots 8, 9 until the central recesses 29 are facing these pivots 8, 9 and that they come in these recesses 29 under the action of the spring 10. The strap is therefore interlocked to the watch case.

Thanks to this fastening device, we can quickly and easily, particularly without any tools, change our own watch strap, while being sure of a good connection between the strap and the watch case.

The invention claimed is:

1. Device for fastening a watch strap to a watch case comprising a hinge pin (1) integral with the watch case (2) and extending from the watch case in a first direction, a fastening element (3) attached to or integrated to an end of said strap provided with two lugs (15) defining between them a space (16) to receive the hinge pin (1), each of these lugs comprising an axial recess (17) leading to said space, each of said axial recesses (17) housing an endstone (21) mounted in a sliding manner in said recess (17) and bearing a push button (20) attached to an external end of the endstone (21), the hinge pin (1) comprising on a lateral face an annular housing (25) opening radially outwardly through a groove (26) in a second direction transverse to said first direction, said annular housing (25) receiving a protrusion (27) located on said lugs (15), whereby, for a user to fasten or remove the watch strap from the watch case, said buttons must be pushed and simultaneously said end of the strap must extend in said second direction and whereby said protrusion can enter or exit said annular housing only through said groove.

2. Device according to claim 1, wherein said endstone (21) is mounted slidably in an end tip (19) in said recess (17).

3. Device according to claim 1, wherein said end tip (19) is comprised by two parts (19*a*, 19*b*), an internal part (19*a*) receiving a return spring (18) and an external part (21*a*) of the endstone (21), and an external part (19*b*) housing said push button (20).

4. Device according to claim 1, wherein said protrusion (27) comprises a guiding cut (28) and, aligned on a longitudinal axis of the axial recess (17), a central recess (29) housing an external end of a pivot (8, 9) on said hinge pin (1).

* * * * *